United States Patent [19]

Rizzio, Jr. et al.

[11] 3,989,336

[45] Nov. 2, 1976

[54] FLEXIBLE CIRCUIT CONNECTOR ASSEMBLY

[75] Inventors: Michael Rizzio, Jr., Glendale Heights; Richard C. Janzow, Palos Heights, both of Ill.

[73] Assignee: Molex Incorporated, Lisle, Ill.

[22] Filed: Apr. 28, 1975

[21] Appl. No.: 572,263

[52] U.S. Cl. ..... 339/74 R; 339/17 F; 339/75 MP; 339/105; 339/176 MF

[51] Int. Cl.[2] ..... H01R 13/62

[58] Field of Search ..... 339/17 F, 74 R, 75 R, 339/75 M, 75 MP, 176 MF, 176 MP, 105

[56] References Cited

UNITED STATES PATENTS

| | | | |
|---|---|---|---|
| 3,090,028 | 5/1963 | Hall | 339/17 F |
| 3,307,139 | 2/1967 | Prise | 339/17 F |
| 3,701,071 | 10/1972 | Landman | 339/176 MP |

*Primary Examiner*—Roy Lake
*Assistant Examiner*—Mark S. Bicks
*Attorney, Agent, or Firm*—Louis A. Hecht

[57] ABSTRACT

A connector assembly for electrically connecting substantially flat flexible circuit to a second circuit element. The connector assembly generally includes a housing having a plurality of terminal receiving cavities formed therein having an opening through which the flexible circuit element is received into the cavity and a floor over which the flexible circuit is supported. A plurality of generally resilient terminals are mounted one in each of the cavities. Each terminal includes a first portion contacting the second circuit element and second portion for contacting the flexible circuit. The second portion is normally spaced from the cavity floor so that the flexible circuit is easily insertable inbetween. The second portion is movable to mechanically press against the flexible circuit for ensuring good electrical contact and preventing withdrawal of the flexible circuit. Also included is actuating means associatable with the terminal for moving the second portion to press against the flexible circuit.

14 Claims, 7 Drawing Figures

FLEXIBLE CIRCUIT CONNECTOR ASSEMBLY

BACKGROUND OF THE INVENTION

1. Field of the Invention

The present invention relates to electrical connectors and, more particularly, to a connector assembly for electrically connecting a substantially flat flexible circuit element to another circuit element.

2. Brief Description of the Prior Art

Flexible circuits and flat cables are well known in the art and have enjoyed a great deal of popularity owing to their ease of use and their ability to be employed in unusual space limitation situations. In the past, the main termination methods used of connecting flexible circuits and flat cables to another circuit element has been soldering, mass bonding, crimping, pressure, welding. These methods of termination, though satisfactory, are not entirely desirable from the point of view of cost, ease of assembly, and reliability.

Another problem in effecting electrical connections between a flexible circuit and another circuit element is caused by the flexibility of the flexible circuit. Because of the flexibility, a flexible circuit is not easily insertable into a housing by means of a force-fit. In addition, once a flexible circuit is thus inserted into a connector, it becomes easily withdrawable from the connector.

SUMMARY OF THE INVENTION

It is, therefore, the principal object of the present invention to provide a connector assembly for electrically connecting a substantially flat, flexible first circuit element including a flat conductive cable to a second circuit element that is low in cost, easy to assemble and reliable.

These and other objects of the present invention are accomplished by one form of the invention currently contemplated. The connector assembly generally includes a housing of insulation material including a terminal receiving cavity formed therein having an opening through which the first circuit element is received into the cavity and a floor over which the first circuit element is supported. A generally resilient terminal is mounted in the cavity. The terminal includes a first portion which contacts the second circuit element and a second portion for contacting the cable. The second portion is normally spaced from the cavity floor so that the first circuit element is easily insertable therebetween. The second portion is movable from its normal position downwardly toward the floor to a contact position in order to mechanically press the second portion against the cable for ensuring good electrical contact and preventing withdrawal of the first circuit element. Actuating means is associatable with the terminal for moving the second portion from its normal position to the contact position.

DESCRIPTION OF THE PREFERRED EMBODIMENTS

The drawings depict two forms of the connector assembly of the present invention, each of which work on the same general principle. One embodiment is illustrated in FIGS. 1–3 while the other embodiment is illustrated in FIGS. 4–7.

Figure 1:
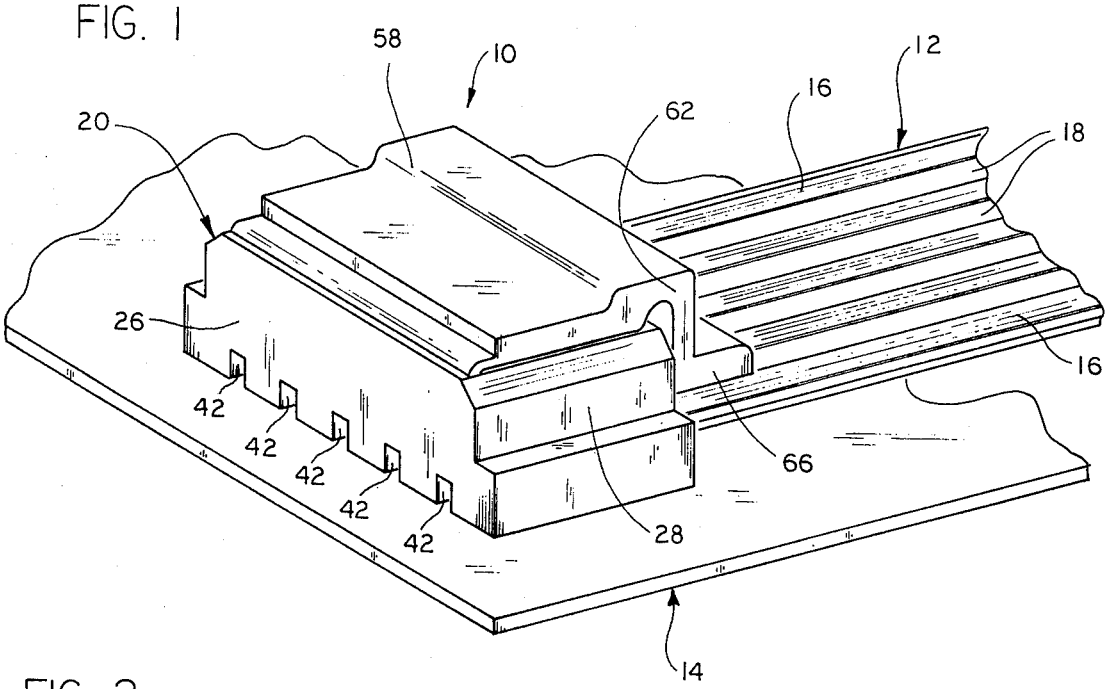
FIG. 1 is a perspective view of one form of the connector assembly of the present invention mounted on a printed circuit board.
Figure 2:
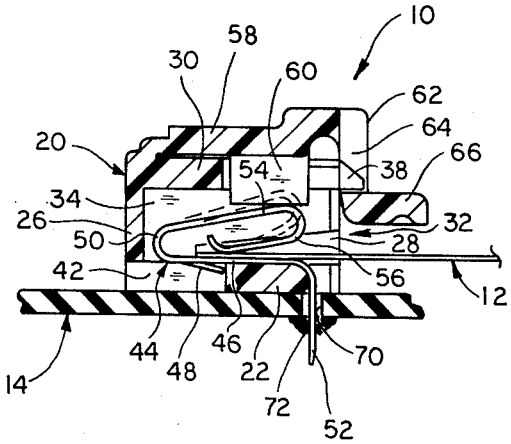
FIG. 2 is a side sectional view of the connector assembly of FIG. 1 showing the different positions of the terminals.
Figure 3:
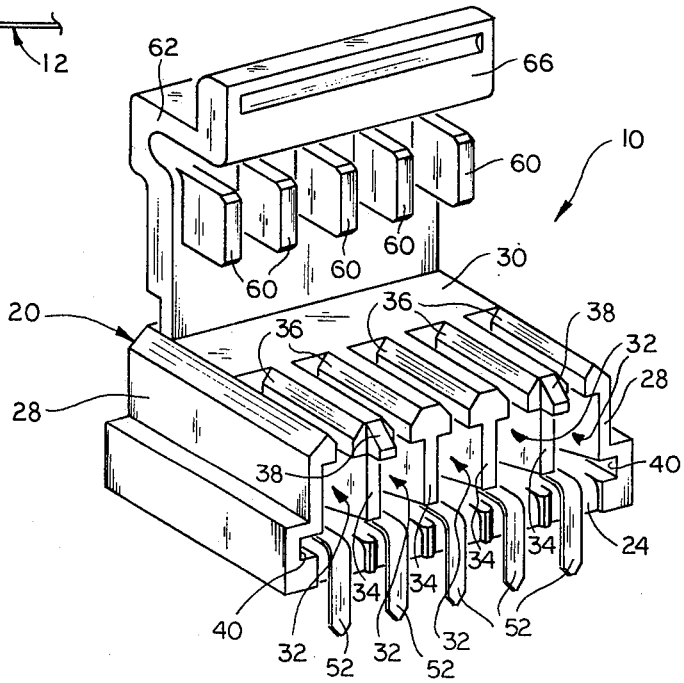
FIG. 3 is a perspective view of the connector assembly of FIG. 1 prior to being mounted on the printed circuit board.
Figure 4:
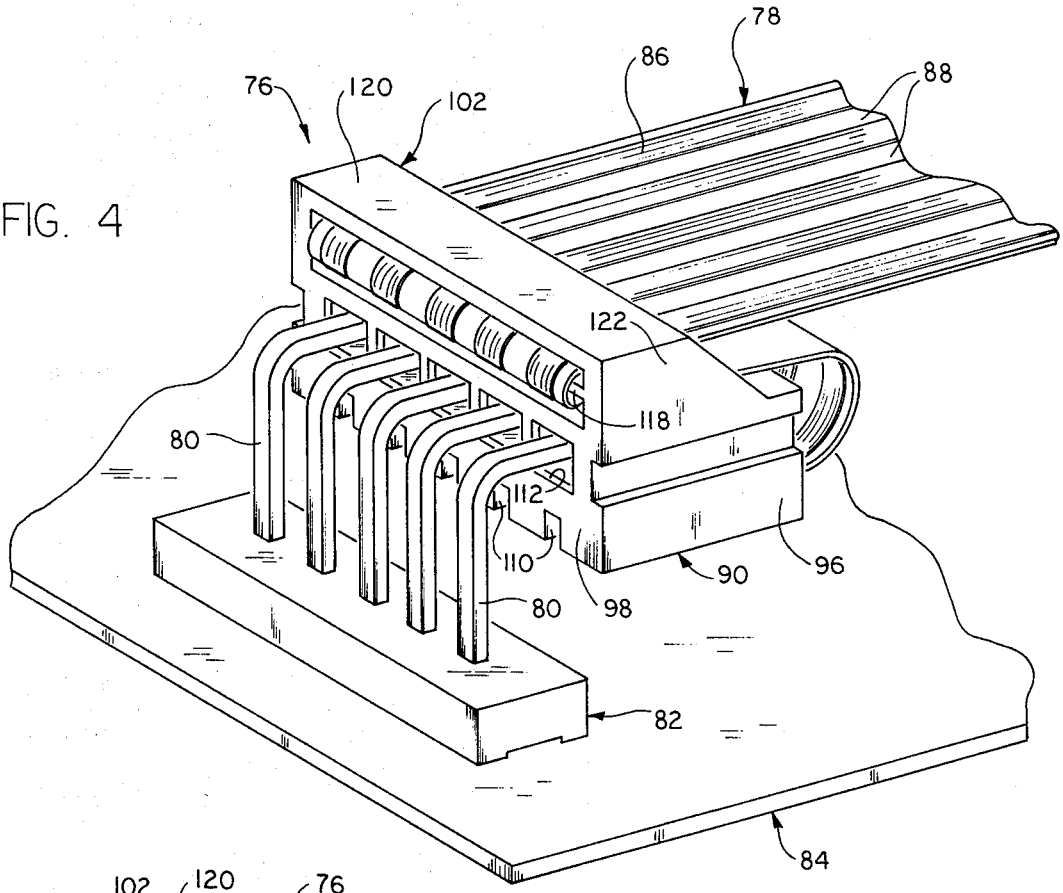
FIG. 4 is a perspective view of another form of the connector assembly of the present invention after it has been fully assembled.

Turning now to the first embodiment as shown in FIGS. 1–3, a connector, generally designated 10, is shown in an assembled configuration. When in an assembled configuration, the connector 10 electrically connects a first circuit element in the form of a flexible circuit with a second circuit element 14, in the form of a printed circuit board. The flexible circuit 12 has a plurality of flexible flat conductive cables 16 printed or mounted on a flexible support surface 18.

The connector 10 has a housing, generally designated 20, made of insulation material. The housing 20 has a bottom wall or floor 22 with a front edge 24, an upstanding back wall 26, two upstanding side walls 28, and a top wall 30. The interior of the housing 20 has a plurality of terminal receiving cavities, generally designated 32, formed therein.

Each cavity 32 is defined between spaced apart parallel vertical walls 34 extending from the back wall 26. The walls 34 have a tapered cut-out portion forming a space from the bottom wall 22 to allow the flexible circuit 12 to be inserted into the interior of the housing 20 so that each cable 16 is located in each cavity 32. Each cavity 32 also includes slots 36 formed at the top of each cavity between the walls 34 and extending from the top wall 30. Latching nibs 38 are provided on the front surface of two of the walls 34 for purposes which will become more apparent hereinafter.

Guide channels 40 are formed on the interior of each side wall 28 to receive and guide the edge of the flexible circuit when the flexible circuit is inserted into the housing 20. The distance between the two channels 40 is substantially the same as the width of the flexible circuit 12.

Slots 42 are formed in the bottom wall 22, one for each cavity 32. These slots 42 aid in retaining terminals in a manner which will be discussed in greater detail hereinafter.

Each cavity 32 receives a generally resilient terminal, generally designated 44. The terminal 44, as best seen in FIG. 2, includes a flat base portion 46 having a locking tang 48 struck therefrom. A pre-loaded loop 50 extends from one end of the base portion 46 while a printed circuit board tail 52 extends from the other end of the base.

Each terminal 44 is mountable in its respective cavity 32 by merely sliding the terminal through the front of the cavity. When fully mounted, the base portion 46 lays over the bottom wall 22, while the locking tang 48 is received in the slot 42 in that cavity. This prevents unintentional withdrawal of the terminal 44 from its respective cavity 32. In addition, the printed circuit board tail 52 wraps around and extends downwardly from the front edge 24 of the bottom wall 22.

When initially inserted, each terminal 44 assumes a pre-loaded position that is illustrated in phantom in FIG. 2. This is the initial or normal position of the terminal 44. The loop portion 50 is movable as a lever so that it can move from its normal position downwardly toward the bottom wall 22 to a contact position to mechanically press against the cable 16 which is received in the respective cavity 32. This is effected by pressing against a top part of the loop 54 so that the bottom part presses against the cable 16.

Actuating means in the form of a hinged door, generally designated 58, is provided to move the loop-shaped portion 50 from its normal position to its contact position. The door 58 includes a plurality of depending protrusions 60 as best shown in FIG. 3. There is one protrusion 60 for each cavity and each is receivable within the respective cavity 32 through the slots 36, when the door is moved from an open position as shown in FIG. 3 to a closed position as shown in FIGS. 1 and 2.

The door 58 has a locking portion 62 with a recess 64 formed therein. The recess 64 receives the latching nibs 38 when the door is in its closed position as best shown in FIG. 2. The door also has a manipulatable lip 66 to move the door between its open and closed positions.

The printed circuit board 14 is provided with a plurality of holes 70 formed therein, one for each printed circuit board tail 52. To mount the connector 10 on the printed circuit board 14, the connector 10 is positioned so that each tail 52 is received through its respective hole 70. Each hole 70 is associated with conductive material (not shown) printed on the board 14. The bottom of the board 14 can then be wave-soldered so that there is a solder connection 72 between the printed circuit board tail 52 and circuitry formed on the printed circuit board 14.

In operation, a flexible circuit 12 is inserted into the interior of the housing 20 so that each cable 16 is received within each cavity 32. At this stage, the door 58 is in its open position and the terminal is in its normal position as shown in phantom in FIG. 2. The door 58 is then moved to its closed position as shown in FIGS. 1 and 2 so that each protrusion 60 engages and presses down against the top part 54 of the loop-shaped portion 50 until the door reaches its closed position. When in the closed position, the loop shaped portion 50 assumes its contact position whereby the bottom part 56 of the loop-shaped portion 50 presses against the cable 16 as best shown in FIG. 2.

Turning now to FIGS. 4–7, another form of a connector, generally designated 76, is illustrated. Connector 76 electrically connects a substantially flat flexible circuit 78 with a conductive pin 80 of a pin connector 82. The pin connector 82 has a plurality of pins 80 and is shown mounted and electrically connected to a printed circuit board 84. The flexible circuit 78 includes a plurality of parallel spaced apart conductive cables 86 on a flexible support surface 58, each cable 86 being adapted to be electrically connected with a pin 80.

The connector 76 includes a housing, generally designated 90, made of insulation material. The housing has a bottom wall 92 with a front edge 94, two upstanding side walls 96, an upstanding back wall 98 and a top wall 100. Strain relief means, generally designated 102 is provided on top of the top wall 100.

The interior of housing 90 has a plurality of terminal receiving cavities 104 formed therein. The interior of the housing 90 is structured so that it is able to receive within each cavity 104 a pin 80 and a cable 86, in electrical connection with one another.

Each cavity is defined between a plurality of upstanding parallel spaced apart walls 106 extending toward the front from the back wall 98. Each cavity wall 106 has a tapered cutout portion at the bottom thereof forming a space from the bottom wall 92 to allow insertion of the flexible circuit 78 into the interior of the housing 90. The edges of the flexible circuit 78 are received in guide channels formed in the interior of side walls 96. The distance between guide channels 108 are substantially the same as the width of the flexible circuit 78.

The bottom wall 92 has a plurality of slots 110, formed therein, one for each cavity 104. These slots 110 aid in mounting terminals within the cavities.

A plurality of openings 112 are provided in the back wall 98 of the housing 90, one opening 112 communicating with each cavity 104. Openings 112 serve to allow communication of a pin 80 into the respective cavity 104.

The strain relief means 102 are seen to include two slots formed between a raised portion 116 on the top wall 100, a tapered edged horizontal wall 118, and an upper horizontal wall 120. Horizontal walls 118 and 120 are supported across two trapezoidal side walls 122. The strain relief means 102 provides a means by which accidental removal of a flexible circuit 78 can be prevented as will be discussed in greater detail hereinafter.

Each cavity 104 has a terminal 126 mounted therein to provide a contact between the conductive cable 86 of the flexible circuit 78 and the pin 80. The terminal is seen to generally include a flat base portion 128 having a locking tang 130 struck therefrom. A pre-loaded loop-shaped portion 132 is formed on one side of the base portion 128 whereas a curled portion 134 is formed on the other end of the base portion.

Figure 5:
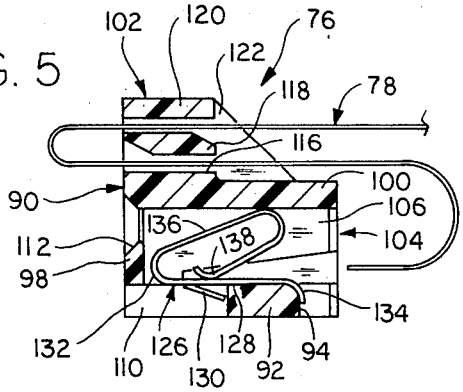
FIG. 5 is a side sectional view of the connector assembly of FIG. 4 showing the terminal in its normal position.

When fully inserted, the terminal 126 has its base portion overlaying the bottom wall 92 with the locking tang 130 received in the respective slot 110. The insertion of locking tang 130 into the slot 110 prevents accidental withdrawal of the terminal 126. A loop-shaped portion 130 is in the position as shown in FIG. 5. The curled portion 134 overhangs the front edge 94 of the bottom wall 92.

Figure 6:
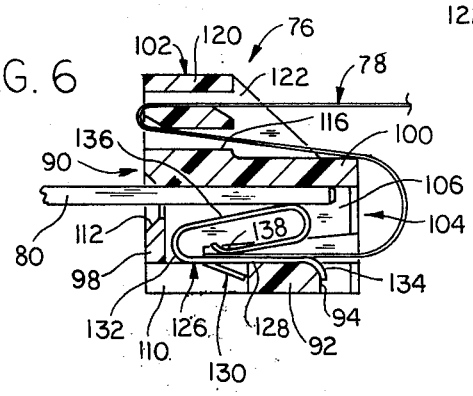
FIG. 6 is a side sectional view of the connector assembly of FIG. 4 showing the terminal in its contact position.
Figure 7:
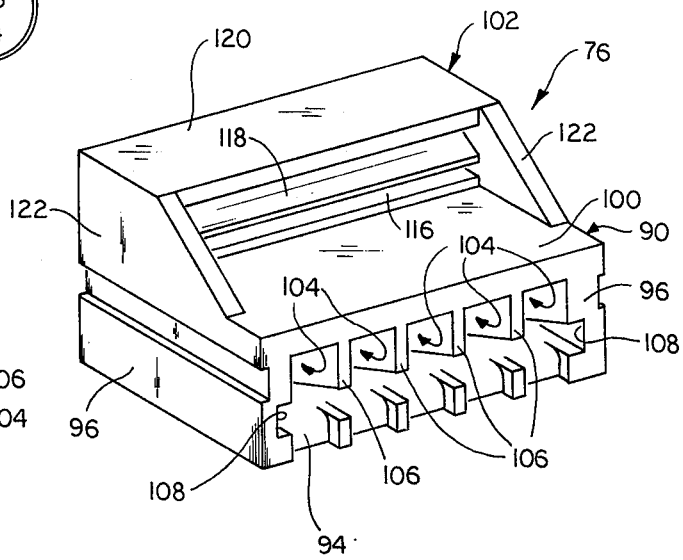
FIG. 7 is a perspective view of the connector assembly of FIG. 4 prior to its assembly.

The loop-shaped portion 132 acts as a lever in that it is movable between a normal position as shown in FIG. 5 and a contact position as shown in FIG. 6. When in the contact position, the loop-shaped portion 132 is mechanically pressed against the respective cable 86 which ensures good electrical contact and aids in preventing withdrawal of the flexible circuit 78.

In operation, the flexible circuit 78 is first threaded through the strain relief means 102 as shown in FIGS. 5 and 6. The flexible circuit 78 is first put through the slot defined between the upper horizontal wall 120 and the tapered horizontal wall 118 in a direction opposite that of the direction of insertion into the interior of the housing 90. The flexible circuit 78 is then threaded between the slot defined between the tapered horizontal wall 118 and the raised portion 116 in a direction opposite that of the direction of insertion into the housing. The end of the flexible circuit 78 is then inserted into the interior of the housing 90 so that each cable 86 is received in its respective cavity 104.

The insertion of a pin 80 through the cavity openings 112 serves as actuating means to move the loop-shaped portion 132 from its normal position to its contact position, as shown in FIG. 6. When thus inserted, the pin 80 engages the top part 136 of the loop-shaped portion 132 thereby causing the bottom part 138 of the loop-shaped portion to press against the respective cable 86. The thickness of the pin 80 is sufficiently large, i.e., greater than the distance between the top wall 100 and the top part 136 of the loop-shaped portion 132, to cause the loop-shaped portion to move in the manner described.

The configuration above described not only provides good mechanical and electrical contact between the cable 78, terminal 126 and pin 80, but also aids in the prevention of accidental withdrawal of the flexible circuit 78 from the interior of the housing 90.

We claim:

1. A connector assembly for electrically connecting a substantially flat, flexible first circuit element including a flat conductive cable to a second circuit element, said connector assembly comprising:

a housing of insulation material including a terminal receiving cavity formed therein having an opening through which the first circuit element is received into the cavity and a floor over which the first circuit element is supported;

a generally resilient terminal mounted in said cavity, said terminal including opposing, normally spaced apart first and second portions for receiving said first circuit element therebetween, said first portion being mounted adjacent said floor and said second portion being movable from its normal position downwardly toward said floor to a contact position to mechanically press the first and second portions against the cable for ensuring good electrical contact and preventing withdrawal of said first circuit element; and actuating means associatable with said terminal for moving said second portion from its normal position to the contact position.

2. The connector assembly of claim 1 wherein said first circuit element includes a plurality of parallel spaced apart cables on a flexible support surface, said housing including a plurality of terminal receiving cavities formed therein having a common slot opening through which the first circuit element is received over a common floor so that each cable is insertable into one cavity, said connector assembly including a plurality of said resilient terminals, one mounted in each cavity to contact and press against the respective cable received therein.

3. The connector assembly of claim 1 wherein said terminal is generally loop-shaped with an upper contact surface defining said second portion and a lower surface defining said first portion, said second circuit element comprising a printed circuit board.

4. The connector assembly of claim 1 wherein said actuating means includes a door hinged to the top of the housing and movable between an open position and a closed position, said door having a depending protrusion adapted to engage said second portion of said terminal to move said second portion to a contact position when said door is moved from its open position to its closed position.

5. The connector assembly of claim 1 wherein said housing includes a second opening through which said pin is receivable into said cavity to engage said second terminal portion, said pin defining said actuating means when it is inserted into the second opening into the cavity, whereby the second portion is moved to the contact position in response to the insertion of said pin.

6. The connector assembly of claim 1 including strain relief means to aid in preventing withdrawal of said first circuit element after insertion.

7. The connector assembly of claim 6 wherein said strain relief means is mounted on said housing and includes first slot means above the cavity opening through which said first circuit element is received in a direction the same as the direction of insertion into the cavity opening and a second slot means intermediate said first slot means and said cavity opening through which said first circuit element is received from said first slot means in a direction opposite the direction of insertion into the cavity opening, after which said first circuit element is inserted into said cavity opening.

8. A connector assembly for electrically connecting a substantially flat, flexible first circuit element having a plurality of flat conductive cables to a second circuit element, said connector assembly comprising:

a housing of insulation material including a plurality of terminal receiving cavities formed therein having a common opening through which said first circuit element is received so that each cable is located in one cavity and a bottom wall over which said first circuit element is supported;

a plurality of generally resilient terminals, one mounted in each of said cavities, each terminal including opposing, normally spaced apart first and second portions for receiving said first circuit element therebetween, said first portion being mounted adjacent said floor and said second portion being movable from its normal position downwardly toward said bottom wall to a contact position to mechanically press the first and second portions against the cable for ensuring good electrical contact and preventing withdrawal of said first circuit element;

a door hinged on top of the housing and movable between an open position and a closed position over said cavities, said door having a plurality of depending protrusions each adapted to engage said second portion of said terminal to move said second portion to a contact position when said door is moved from its open position to its closed position.

9. The connector assembly of claim 8 wherein each terminal is generally loop-shaped with an upper contact surface defining said second portion and a lower contact surface defining said first portion, said second circuit element comprising a printed circuit board.

10. The connector assembly of claim 8 wherein said door has latch means for removably holding said door in a closed position.

11. A connector assembly for electrically connecting the substantially flat, flexible first circuit element having a plurality of flat conductive cables to a second circuit element having a plurality of conductive pins, one for each cable, said connector assembly comprising:

a housing of insulation material including a plurality of terminal receiving cavities formed therein having a common opening through which said first circuit element is received so that each cable is located in one cavity, a bottom wall over which said first circuit element is supported, and an opening in each cavity for receiving a conductive pin therethrough; and a plurality of generally resilient terminals, one mounted in each of said cavities, each terminal including opposing, normally spaced apart first and second portions for receiving said first circuit element therebetween, said first portion being mounted adjacent said floor and said second portion being movable from its normal position downwardly toward said bottom wall to a contact position to mechanically press the first and second portions against the cable for ensuring good electrical contact and preventing the withdrawal of said first circuit element, each conductive pin engaging one second terminal portion when inserted into a cavity so that said one second portion moves to its contact position in response to the insertion of the conductive pin into the cavity.

12. The connector assembly of claim 11 wherein each terminal is loop-shaped with a lower contact surface defining said first terminal portion and an upper contact surface defining the second terminal portion.

13. The connector assembly of claim 11 including strain relief means to aid in preventing withdrawal of said first circuit element after insertion.

14. The connector assembly of claim 13 wherein said strain relief means is mounted on said housing includes first slot means above the cavity opening through which said first circuit element is received in a direction the same as the direction of insertion into the cavity opening, and a second slot means intermediate said first slot means and said cavity opening through which said first circuit element is received from said first slot means in a direction opposite the direction of insertion into the cavity opening, after which said first circuit element is inserted into said cavity opening.

* * * * *

UNITED STATES PATENT AND TRADEMARK OFFICE

Certificate

Patent No. 3,989,336 Patented November 2, 1976

Michael Rizzio, Jr. and Richard C. Janzow

Application having been made by Michael Rizzio, Jr. and Richard C. Janzow, the inventors named in the patent above identified and Molex Incorporated, Lisle, Illinois, a corporation of Delaware, the assignee, for the issuance of a certificate under the provisions of Title 35, Section 256, of the United States Code, adding the name of Edward G. Caporellie as a joint inventor, and a showing and proof of facts satisfying the requirements of the said section having been submitted, it is this 26th day of July 1977, certified that the name of the said Edward G. Caporellie is hereby added to the said patent as a joint inventor with the said Michael Rizzio, Jr. and Richard C. Janzow.

FRED W. SHERLING,
*Associate Solicitor.*